US006021587A

United States Patent [19]

Chen

[11] Patent Number: 6,021,587

[45] Date of Patent: Feb. 8, 2000

[54] SHOE INSOLE

[76] Inventor: Hui-Ling Chen, No. 2, Lane 157, Hsin Yi Rd., Hai Pu Village, Hu Nei Hsian, Kaohsiung Hsien, Taiwan

[21] Appl. No.: 09/096,186

[22] Filed: Jun. 12, 1998

[51] Int. Cl.[7] ..... A43B 13/38

[52] U.S. Cl. ..... 36/43; 36/44; 36/71

[58] Field of Search ..... 36/43, 44, 71

[56] References Cited

U.S. PATENT DOCUMENTS

| | | | |
|---|---|---|---|
| 4,783,910 | 11/1988 | Boys, II et al. | 36/107 |
| 4,815,221 | 3/1989 | Diaz | 36/27 |
| 4,833,795 | 5/1989 | Diaz | 36/29 |
| 4,907,355 | 3/1990 | Allen et al. | 36/131 |
| 5,319,866 | 6/1994 | Foley et al. | 36/91 |
| 5,367,791 | 11/1994 | Gross et al. | 36/31 |
| 5,709,954 | 1/1998 | Lyden et al. | 36/114 |
| 5,843,268 | 12/1998 | Lyden et al. | 36/114 |

*Primary Examiner*—Paul T. Sewell
*Assistant Examiner*—J. Mohandesi
*Attorney, Agent, or Firm*—Browdy and Neimark

[57] ABSTRACT

A shoe insole is composed of a toe portion, a sole portion and a heel portion. The insole has a thickness of 2 mm or more. The toe portion and the sole portion have a hardness value ranging between 20 and 45 degrees in the Asker Type C, whereas the heel portion has a hardness value ranging between 30 and 50 degrees in the Asker Type C. The hardness values of the toe portion, the sole portion and the heel portion are decreased by at least 5 degrees for an increase in the thickness of the insole by 1 mm.

3 Claims, 1 Drawing Sheet

SHOE INSOLE

FIELD OF THE INVENTION

The present invention relates generally to a shoe, and more particularly to an insole of the shoe.

BACKGROUND OF THE INVENTION

The conventional shoe insole has a uniform thickness and a uniform rigidity throughout the entire body of the shoe insole. Such a conventional shoe insole is thus incapable of providing the toe portion, the sole portion and the heel portion of a foot with a maximum wearing comfort.

SUMMARY OF THE INVENTION

The primary objective of the present invention is to provide a shoe with an insole capable of providing the toe portion, the sole portion and the heel portion of a foot with a maximum wearing comfort.

In keeping with the principle of the present invention, the foregoing objective of the present invention is attained by an insole comprising a toe portion, a sole portion, and a heel portion. The toe portion has a hardness value ranging between 20 and 45 degrees in Asker Type C Test. The sole portion has a hardness value similar to that of the toe portion. The heel portion has a hardness value ranging between 30 and 50 degrees in Asker Type C Test.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
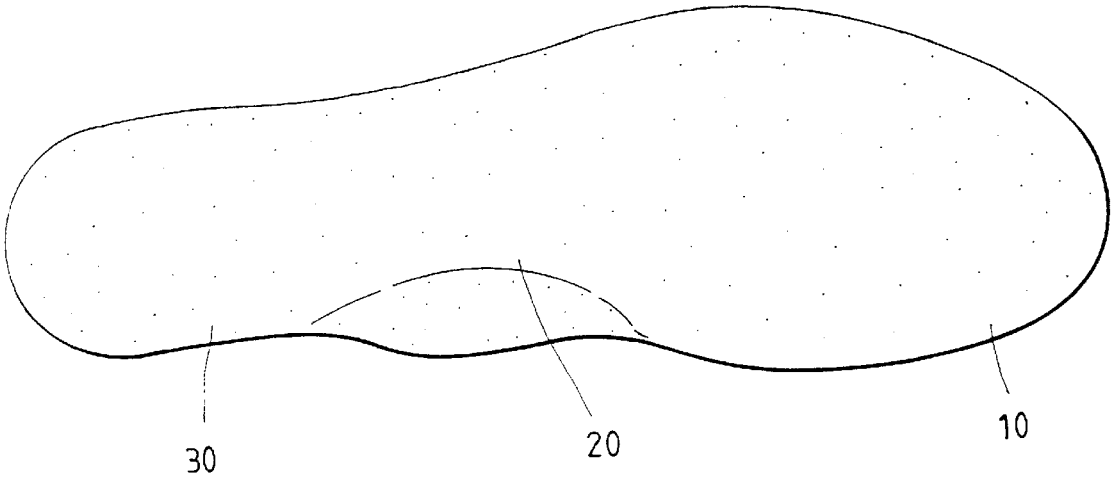
FIG. 1 shows a schematic view of an insole embodied in the present invention.

As shown in FIG. 1, a shoe insole embodied in the present invention is made of a polyurethane (PU) or ethylene vinyl acetate (EVA) foam material having a thickness of 2 mm or more. The shoe insole of the present invention is composed of a toe portion 10, a sole portion 20, and a heel portion 30.

A shoe insole of a first preferred embodiment of the present invention is made of a PU or EVA foam material having a thickness of 3 mm. The shoe insole is composed of a toe portion 10, a sole portion 20, and a heel portion 30. The toe portion 10 has a hardness value ranging between 35 and 45 degrees in the Asker Type C, with the hardness value preferably being 42. The sole portion 20 has a hardness value ranging between 35 and 45 degrees in the Asker Type C, with the hardness value preferably being 44. The heel portion 30 has a hardness value ranging between 40 and 50 degrees in the Asker Type C. The hardness value of the heel portion 30 is preferably 45.

A shoe insole of a second preferred embodiment of the present invention in made of a PU or EVA foam material having a thickness of 4 mm. The shoe insole of the second preferred embodiment of the present invention is composed of a toe portion 10, a sole portion 20, and a heel portion 30. The toe portion 10 has a hardness value ranging between 30 and 40 degrees in the Asker Type C, preferably 35. The sale portion 20 has a hardness value ranging between 30 and 40 degrees in the Asker Type C, preferably 37. The heel portion 30 has a hardness value ranging between 35 and 45 degrees in the Asker Type C, preferably 43.

A shoe insole of a third preferred embodiment of the present invention is made of a PU or EVA foam material having a thickness of 5 mm. The shoe insole of the third preferred embodiment of the present invention is composed of a toe portion 10, a sole portion 20, and a heel portion 30. The toe portion 10 has a hardness value in the range of 20 to 35 degrees in the Asker Type C, with the hardness value preferably being 30. The sole portion 20 has a hardness value in the range of 20 to 35 degrees in the Asker Type C, with the hardness value preferably being 32. The heel portion 30 has a hardness value in the range of 30 to 40 degrees in the Asker Type C, with the hardness value preferably being 34.

In light of the three embodiments described above, it must be noted here that the hardness values of the toe portion 10, the sole portion 20 and the heel portion 30 of the shoe insoles are decreased by at least 5 degrees for an increase in the thickness of the insole by 1 mm. In general, the toe portion 10 of the present invention has a hardness value ranging between 20 and 45 degrees in the Asker Type C. The sole portion 20 has a hardness value ranging between 20 and 45 degrees in the Asker Type C. The heel portion 30 has a hardness value ranging between 30 and 50 degrees in the Asker Type C.

What is claimed is:

1. A shoe insole comprising a toe portion, a sole portion and a heel portion wherein a hardness value of said toe portion is 42 degrees in the Asker Type C; wherein a hardness value of said sole portion is 44 degrees in the Asker Type C; and wherein a hardness value of said heel portion is 45 degrees in the Asker Type C.

2. A shoe insole comprising a toe portion, a sole portion and a heel portion wherein a hardness value of said toe portion is 35 degrees in the Asker Type C; wherein a hardness value of said sole portion is 37 degrees in the Asker Type C; and wherein the hardness value of said heel portion is 43 degrees in the Asker Type C.

3. A shoe insole comprising a toe portion, a sole portion and a heel portion wherein a hardness value of said toe portion is 30 degrees in the Asker Type C; wherein a hardness value of said sole portion is 32 degrees in the Asker Type C; and wherein a hardness value of said heel portion is preferably 34 degrees in the Asker Type C.

* * * * *